United States Patent [19]

Reichental et al.

[11] Patent Number: 5,072,637

[45] Date of Patent: Dec. 17, 1991

[54] APPARATUS AND METHOD FOR SEGMENTING CONTINUOUS WEBS INTO PREDETERMINED LENGTHS

[75] Inventors: Abraham N. Reichental, Southbury; Alex Shafir, Watertown, both of Conn.

[73] Assignee: Sealed Air Corporation, Saddle Brook, N.J.

[21] Appl. No.: 516,799

[22] Filed: Apr. 30, 1990

[51] Int. Cl.[5] ..... B26D 7/04

[52] U.S. Cl. ..... 83/23; 83/155; 83/13; 83/277; 83/422; 226/172

[58] Field of Search ..... 83/267, 277, 139, 422, 83/436, 155, 23, 26; 53/389; 493/372; 226/172

[56] References Cited

U.S. PATENT DOCUMENTS

| | | | |
|---|---|---|---|
| 2,036,012 | 3/1936 | Bellinghausen . | |
| 2,940,504 | 6/1960 | Jacquet . | |
| 2,947,358 | 8/1960 | Hawxhurst . | |
| 3,267,781 | 8/1966 | Sterns et al. . | |
| 3,277,764 | 10/1966 | Henc . | |
| 3,620,432 | 11/1971 | Emery | 226/172 |
| 3,761,003 | 9/1973 | Sieurin | 226/172 |
| 3,971,277 | 7/1976 | Kowalski et al. | 83/176 |
| 3,972,271 | 8/1976 | Seragnoli | 493/372 |
| 4,034,634 | 7/1977 | Arbter | 83/18 |
| 4,183,271 | 1/1980 | Martin | 83/156 |
| 4,313,781 | 2/1982 | Rovigo | 493/372 |
| 4,432,746 | 2/1984 | DeHaan | 83/176 |
| 4,488,466 | 12/1984 | Jones | 83/175 |
| 4,512,227 | 4/1985 | Salvagnini | 83/277 |
| 4,620,467 | 11/1986 | Margraf et al. | 83/389 |

FOREIGN PATENT DOCUMENTS

| | | | |
|---|---|---|---|
| 429584 | 7/1967 | Switzerland | 226/172 |

*Primary Examiner*—Daniel C. Crane

*Attorney, Agent, or Firm*—Bell, Seltzer, Park & Gibson

[57] ABSTRACT

An apparatus and method for cutting continuous webs having varying thicknesses, widths, and compositions into sheets. The apparatus includes a pair of oppositely rotating web feed assemblies employing a unique floating nip and clamping mechanism which engages the web and advances it a specified length past a poised cutting blade assembly and onto a simultaneously driven exit assembly. After the desired length of web has been fed, the drive mechanisms stop, and the cutting blade assembly cycles to clamp the web on the upstream side and cut. During the cutting stroke the web is held taut on the downstream side by the web feed assemblies. Upon completion of the clamping and cutting stroke, the cutting blade assembly returns and stops at its poised position.

16 Claims, 3 Drawing Sheets

APPARATUS AND METHOD FOR SEGMENTING CONTINUOUS WEBS INTO PREDETERMINED LENGTHS

FIELD OF THE INVENTION

The present invention relates to cutting package wrapping sheets. More particularly, this invention is directed to an improved method and apparatus for cutting a sheet from a continuous web into predetermined lengths.

BACKGROUND OF THE INVENTION

Protective packaging for various size and shape packages presents a common problem in the packaging industry. Packaging used in wrapping machines is typically pliable to permit proper wrapping of a package by the machine. The soft, stretchy characteristics of the packaging necessary for a good wrap tend to make cutting or severing a sheet from a continuous web difficult. Normally used are knife blades having a serrated cutting edge defining sharp cutting points which initially pierce the web to facilitate cutting or tearing of the web along the length of the cutting blade.

One design of packaging machine provides for wrapping packages, particularly articles supported on trays, by elevating the packages into stretched film sheets. The sheets are severed from a continuous web by means of a pivotally mounted, cam actuated knife blade. The knife blade includes an upwardly extending serrated cutting edge which is reciprocated through a web drawn from the continuous web source. A bracket mounted above the drawn web defines a channel into which the knife blade is inserted to sever a sheet from the continuous web.

Other cutting devices have been developed to more easily cut soft, pliable packaging materials. However, such cutters tend to be complicated, expensive or deficient in some other respect. One such improved cutting device is described in U.S. Pat. No. 4,620,467 to Margraf et al. which discloses a cutting device for packaging material using knives on each side of the web to cut the web while the web is held immobile on the upstream side.

The need exists for a further improved cutter to be used with a package wrapping machine wherein soft, pliable continuous web material is severed into sheets to be wrapped about packages by the wrapping machine. To be effective, the improved film cutter must be reliable, inexpensive and, preferably, be easily useable with existing wrapping machines to permit the use of a larger variety of materials by the machine.

Therefore, it is an object of this invention to provide a method and apparatus for segmenting a continuous web into sheets of predetermined length.

Another object of this invention is to provide an apparatus for segmenting a continuous web wherein the effectiveness of the cutting step is enhanced by web clamping means on both the upstream and downstream side of the cutting blade.

A further object of this invention is to provide a web cutting apparatus having a self-adjusting web delivery means which eliminates web jamming and enhances safety.

It is a further object of this invention to provide an apparatus and method for simply and reliably cutting soft, pliable web material of irregular thicknesses.

SUMMARY OF THE INVENTION

In accordance with the present invention, these and other objects, features and advantages are achieved in the embodiments illustrated herein, by the provision of a method and apparatus for segmenting a continuous web into sheets of predetermined length. A continuous web is passed through the nip of a web delivery means having means to self-adjust the resistance of the nip force depending upon the thickness of the web, and a predetermined length is passed to a web clamping and cutting area. The web is held immovably in place during the cutting operation on both the downstream and upstream sides of the cut. After the web has been segmented the sheet is passed from the web cutting means and another segment of web is moved in place for the next cut. The web delivery means allows the force applied at the nip to automatically adjust, allowing easy entry into the nip of a range of web material thicknesses and compositions.

While the apparatus of the present invention was designed with soft stretchable films, such a those used in package wrapping machines, in mind, those skilled in the art will readily understand that the apparatus and method of the present invention is not so limited and may be used in the paper, film and textile manufacturing industries or such other industries where these web handling techniques may be applicable.

BRIEF DESCRIPTION OF THE DRAWINGS

Other objects, features and advantages of the invention will be apparent from the detailed description of the invention when take in conjunction with the accompanying drawings, in which.

DESCRIPTION OF THE PREFERRED EMBODIMENTS

Figure 1:
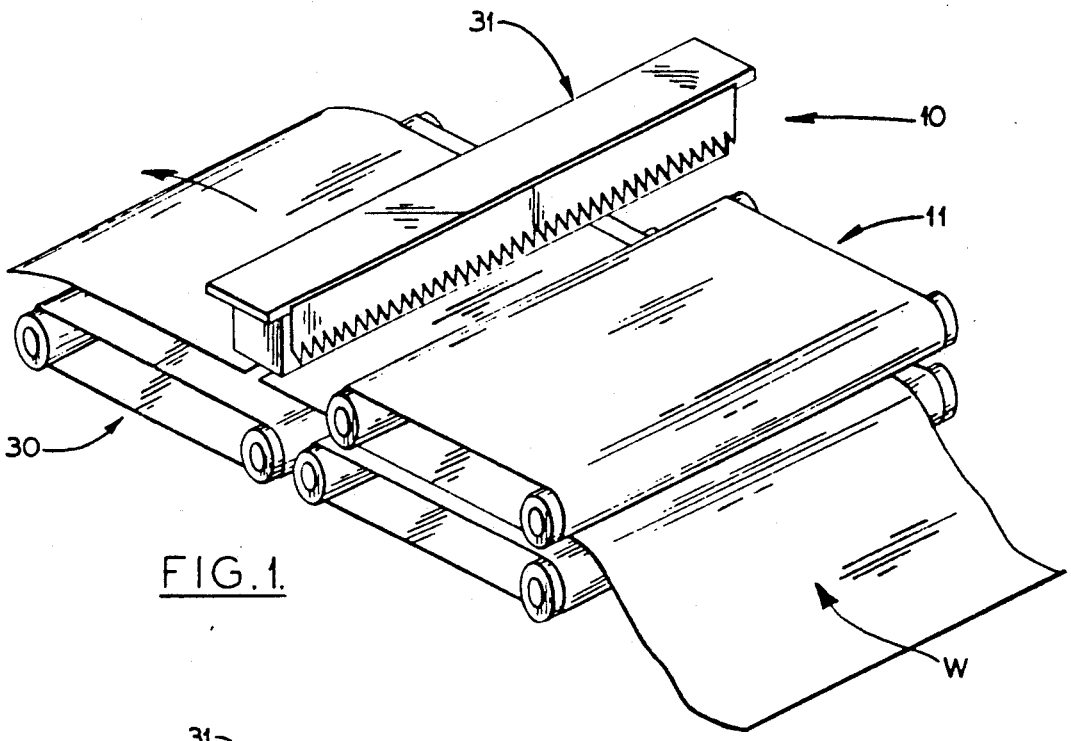
FIG. 1 is a perspective view of a schematic of the web segmenting apparatus which embodies the features of the invention.

Referring now more specifically to the drawings, there is shown in FIG. 1 an embodiment of an apparatus for segmenting a continuous web into predetermined lengths in accordance with the present invention. In the illustrated embodiment, the web segmenting apparatus is generally indicated at 10, and it comprises a web delivery means 11 and a web cutting means 30, both mounted in a frame (not shown). A continuous web W is supplied to the web delivery means, normally from a bulk supply roll supported on a free rolling armature. While the apparatus of the present invention is useful for cutting webs from a variety of material and thicknesses, it has been found to be especially suited for cutting plastic films of soft, pliable material used in packaging, such as high density polyethylene. It has been found that the apparatus of this invention is particularly well suited to cut webs of varying thicknesses.

Figure 2:
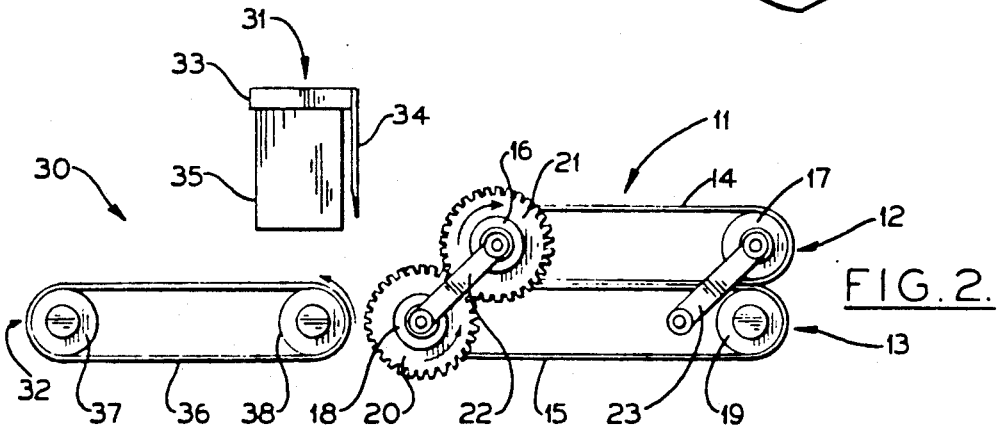
FIG. 2 is a schematic side view of the web segmenting apparatus without the presence of a continuous web.

As shown more clearly in FIG. 2, web delivery means 11 comprises an upper feed assembly 12 and a lower feed assembly 13, positioned One above the other forming a nip which allows the segmenting apparatus to receive and feed a continuous web having a varying range of thickness and composition without adjustment by the operator. In a preferred embodiment, upper feed assembly 12 and lower feed assembly 13 are belt assemblies formed from endless belts 14, 15 between which web W passes. The belt assemblies formed by belts 14, 15 are substantially parallel to each other and are supported by rollers, respectfully 16, 17, 18, 19 suitably mounted to the frame. It should be understood the upper feed assembly and lower feed assembly may comprise other embodiments such as oppositely disposed rollers positioned to form a nip and provide web delivery and clamping functions.

The upper feed assembly 12 and lower feed assembly 13 are interconnected by a drive means. Any suitable drive means such as gears 20, 21 may be used. The driving gear 20 is located on the upstream end of the lower feed assembly 13. Upper and lower feed assemblies 12, 13 form a floating nip through which a continuous web W is advanced from a supply roll. Upon activation of an appropriate motor (not shown) which engages a drive gear, shown in FIG. 3 as spur gear 20, the feed assemblies advance the web W through the nip. The gear linkage 20, 21 may be controlled by a clutch/-brake assembly. The gears drive the upper and lower assemblies, shown in FIG. 2 as lower drive belt 15 and upper floating belt 14, in opposite directions as illustrated by the arrows, offering upper and lower friction surfaces to deliver the web W therebetween along a predetermined substantially horizontal path to the web cutting means 30.

Upper floating feed assembly 12, is connected to lower drive feed assembly 13 by a four point pivoting parallelogram armature shown by linkage armatures 22, 23 and provide means for reducing resistance of the web as the web enters the nip. The orientation and location of the upper floating feed assembly 12 in relation to the lower drive feed assembly 13 is important to the efficacy of both the initial feeding of the web, and the cutting and clamping function, as will be explained.

The web cutting means 30 is positioned upstream from the web delivery means 11, and comprises a cutting blade and clamping assembly 31 extending laterally across the plane of the web and a second web clamping means, shown in FIG. 1 as lower web exit clamping means 32.

The cutting blade and clamping assembly 31 comprises an assembly support 33 to which cutting blade 34 and an upper web exit clamping means 35, are attached in web engaging relationship. The cutting blade 34 is attached to assembly support 33 on the downstream side of the assembly from the upper web exit clamping means 35, and preferably has a serrated cutting edge facing the web. In one embodiment the upper web exit clamping means 35 is a strip made of resilient material, preferably an antistatic foam.

Figure 7:
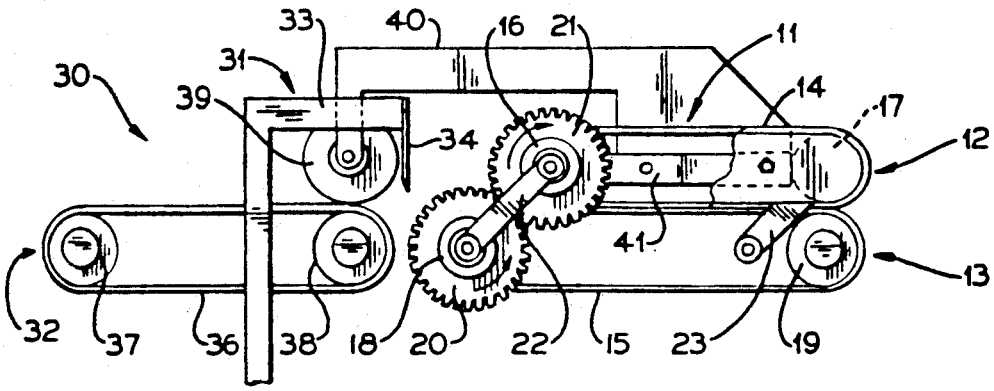
FIG. 7 is a schematic side view of the web segmenting apparatus illustrating another embodiment of the web cutting means.

In another embodiment of the web cutting means shown in FIG. 7, upper exit clamping means comprises roller 39 interconnected and co-acting with upper feed assembly 12 through a pair of arms 40 supporting each end of roller 39 and attached to end plates 41 on each side of upper feed assembly 12. The upper exit clamping roller 39 is linked to lower exit web means 32 by a suitable means such a flexible shaft and may be positively driven to assist the web and cut sheets through web cutting means 30. It is also desirable to rotate roller 39 slightly faster than the assemblies interconnected thereto. As also shown in FIG. 7, the cutting blade 34 is attached to assembly support 33.

In one embodiment, lower web exit means 32 is a belt assembly formed from endless belt 36 supported by rollers 37, 38 mounted to the frame. Lower exit web means 32 is connected to the lower feed belt assembly drive to provide a positive advancement of a severed sheet to a further workstation.

The length of the segmented sheet and activation of the cutting cycle may be accomplished in any number of ways. One such example is to use a modular electronic control means which may be programmed to sever webs of different lengths and amounts. This allows flexible operator orientation to the machine while performing a variety of protective packaging tasks under diverse machine installation conditions. The web feed delivery cycle and web cutting cycle are activated via a keypad on the programmable electronic control unit. The preset web lengths can also be created by activating a foot switch. Using the apparatus of this invention, webs of precise length may be cut.

Figure 3:
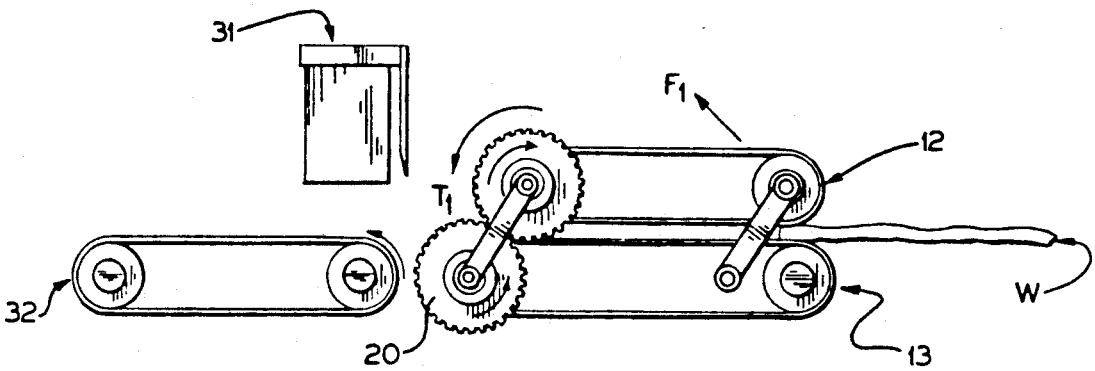
FIG. 3 is a schematic side view of the web segmenting apparatus illustrating the web feeding phase.

Now to describe the operation of the present invention in more detail, as shown in FIG. 3, a continuous web W is advanced into the nip of the web delivery means 11, while the interconnected upper floating feed assembly 12, lower feed belt assembly 13, and exit assembly 32 are running. The cutting blade and clamping assembly 31 is poised, out of the way of the generally horizontal predetermined path of the web material.

As the end of continuous web W is contacted with the nip of web delivery means 11 a higher level of resistance is exerted on the upper floating feed assembly 12 than to the lower feed assembly 13. The change in resistance between the upper floating feed assembly and the lower feed assembly exerts a greater torque resistance between the gears 20, 21. This causes the upper floating feed assembly to ride up onto the lower feed assembly drive gear 20, shown as torque $T_1$ in FIG. 3 thereby reducing the force of the upper floating feed assembly 12 on the web W as the web enters the nip area. The reduced downward force of the upper floating feed assembly 12 is illustrated by arrow $F_1$. This action facilitates the web entry into the nip, formed, as shown in FIG. 2, by endless belts 14, 15.

After the web begins to feed through web delivery means 11, the change in resistance between the upper floating feed assembly and lower feed assembly on the web equalizes and the full force of the upper floating feed assembly will bear down in an even pressure over the surface of the moving web. Should web thickness vary in a given web, the gear assembly 20, 21 will act as a governor that constantly adjusts and equalizes the upper floating feed assembly resistance on the moving web to that of the lower feed assembly. In the preferred embodiment, the surface and composition of belts 14, 15 are tailored to exert a desired amount of friction on a variety of fibrous and calendared web materials assuring positive feeding, driving, and clamping.

The ease of automatically lifting upper floating feed assembly 12 when it is subjected to a higher resistance also offers the safety feature of not severely pinching hands and fingers should they be inserted into the nip. A safety switch on the upper floating feed assembly immediately cuts power to the entire apparatus if the upper floating feed assembly is lifted beyond a predetermined height. The cutting blade assembly 31 cannot move from the poised position when the power is off.

Figure 4:
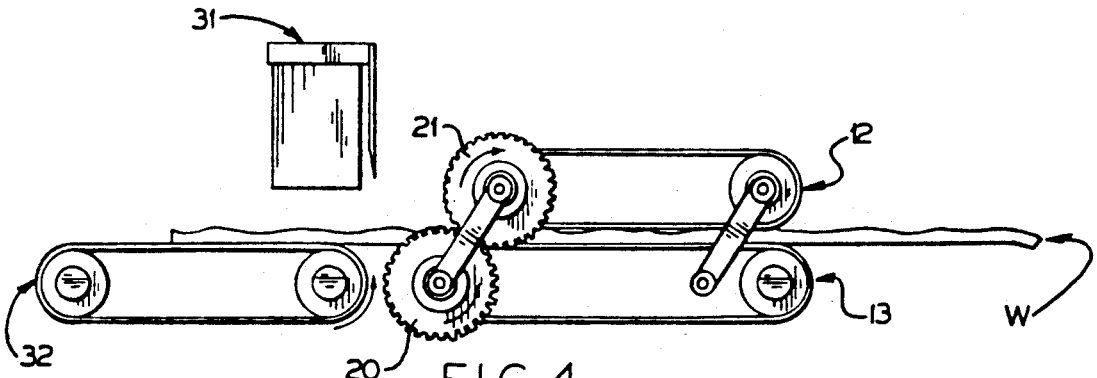
FIG. 4 is a schematic side view of the web segmenting apparatus illustrating the web fed to the web cutting area.

As shown in FIG. 4, after feeding, the web W is passed through the clamping and cutting area and onto the lower exit clamping means 32 of web cutting means 30 which is simultaneously driven, and stopped, by a link to the lower drive feed assembly 13. When the desired length of web material is moved past the clamping and cutting area, a clutch-brake stops all three of the interconnected assemblies.

Figure 5:
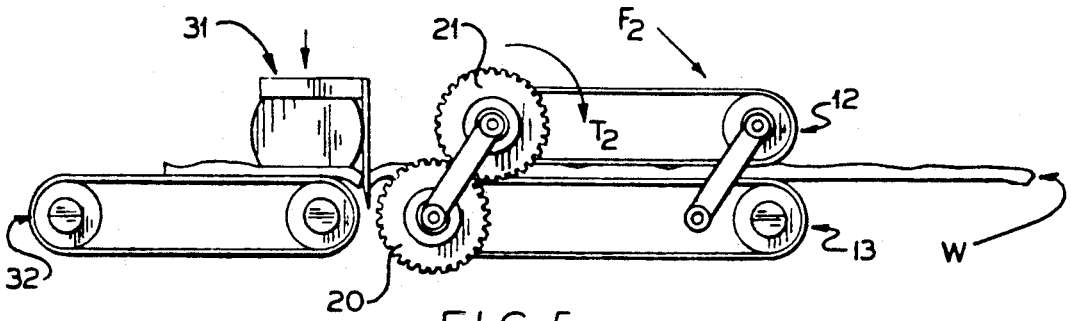
FIG. 5 is a schematic side view of the web segmenting apparatus illustrating the clamping and cutting phase.

The up and down clamping and cutting cycle of assembly 31 is operated through a second clutch engaging a shaft fitted with a pair of cams at each end. In operation, the cutting blade and clamping assembly 31 moves vertically on a pair of linear bearings mounted to the frame. In one embodiment the bottom surface of the clamping strip 35, when fully expanded, extends below the blade edge when the assembly is in its raised position, as shown in FIG. 4. As the cutting blade and clamping assembly 31 are lowered the clamping strip contacts the web, clamping the web firmly against the stopped lower web exit clamping means 32 before the blade edge pierces the web. After the blade edge passes completely through the web to the lowest position in the cycle as shown in FIG. 5, the blade recycles to the its raised position shown in FIG. 6 and holds until the clutch engages again to pass the blade through another cycle. When the embodiment shown in FIG. 7 is used, roller 39 serves the same clamping function as clamping strip 35.

When the blade cuts through the web, a tensile force on both the upstream and downstream sides of the web is exerted towards the blade. It is necessary to resist this force on both sides of the blade and provide a taut cutting plane across the web for effective and consistent cutting. The upstream side of the web is clamped sufficiently by the coefficient of friction between the clamping strip 35 and the rigid flat surface of the lower web exit clamping means 32.

The downstream side of the web is retained taut by the unique clamping function of the upper floating feed and lower drive feed assemblies. When the blade begins to pass through the web, the downstream side of the web engaged by web delivery means 11 is pulled from between the upper floating feed and lower drive feed assemblies. The upper feed assembly, because it is free to move on its parallelogram armature begins to rotate on gear 21 as shown in FIG. 5. The fixed lower drive feed assembly 13 and drive means 20, 21 are held stable by the clutch/brake mechanism. As the floating upper feed assembly 12 rotates, shown by torque $T_2$, the engaged gears drive the upper feed assembly downstream firmly toward the web, as shown by force $F_2$. The more the upstream side of the web is pulled in the direction of the blade, the more the clamping force on the web. This assures a taut cutting plane across the web.

When the embodiment of FIG. 7 is used, the interconnecting arms between the upper clamping roller 39 and the upper feed assembly cause the upper clamping roller to lift when the upper feed assembly 12 rotates as a result of the lifting pressure of $T_1$ from a web entering the nip and to apply clamping pressure when the upper feed assembly applies clamping pressure.

Figure 6:
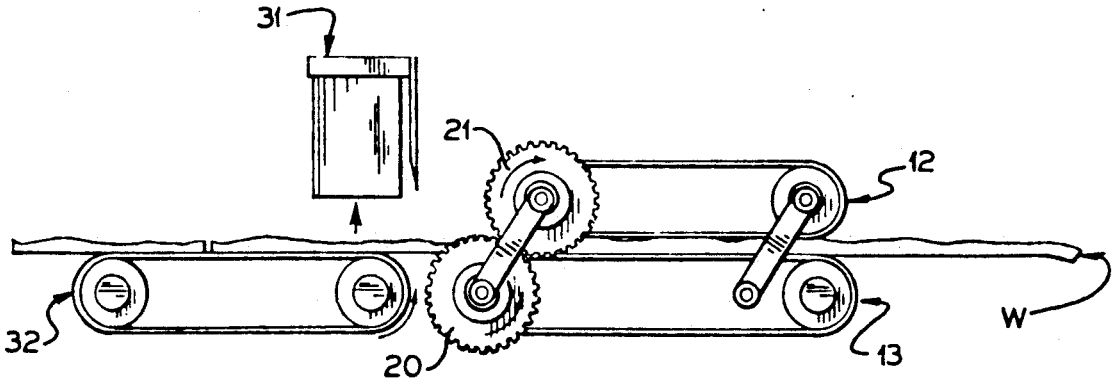
FIG. 6 is a schematic side view of the web segmenting apparatus illustrating the cut web exit and next web feeding phase.

After the clamp/cut cycle is completed, as shown in FIG. 6, the drive mechanisms will re-engage and feed the next desired length. After a web is cut, the lower web exit clamping means 32 advances the severed web until the forward end protrudes sufficiently out of the machine exit to passed to a further workstation or to be safely removed manually. Because lower web exit clamping means 32; upper floating feed assembly 12; and lower feed assembly 13 are linked, at least a minimum length is always fed past the cutting area after each clamp/cut cycle. When the shortest possible length is desired, the clamp/cut cycle activate immediately, omitting the initial feed drive length, followed by the minimum exit feed drive cycle or the feed length cycle required for the next desired web assuring accuracy of the length of the cut web.

The invention has been described in detail with particular reference to a preferred embodiment and the operation thereof, but it is understood that variations, modifications, and the substitution of equivalent means can be effected within the spirit and scope of this invention.

That which is claimed is:

1. An apparatus for continuous web segmenting into sheets of predetermined length comprising:

continuous web supply means;

web delivery means comprising upper feed assembly and lower feed assembly positioned one above and forced against the other forming a nip for receiving said continuous web said nip being resistant to the introduction of said web, said upper and lower feed assembly being interconnected by a drive means whereby said feed assemblies are positively driven in opposite directions, said feed assemblies forming oppositely disposed upper and lower friction surfaces whereby said continuous web is delivered therebetween along a predetermined path of travel to web cutting means, said upper feed assembly being adapted to reduce the force exerted by said upper feed assembly against said lower feed assembly as said continuous web enters said nip and said upper feed assembly being adapted to increase the clamping force on said continuous web during segmenting, web cutting means downstream of said web delivery means comprising cutting blade for segmenting said continuous web while said continuous web is clamped between said upper and lower feed assemblies, and upper web exit clamping means extending laterally across the plane of said web, and lower web exit clamping means disposed on the opposite side of said web from said upper web exit clamping means to facilitate the severance of said continuous web, and means for removing said severed web from said web cutting means.

2. The apparatus defined in claim 1 wherein said upper feed assembly comprises a belt assembly and said lower feed assembly comprises a belt assembly.

3. The apparatus defined in claim 2 wherein said means for reducing resistance of said continuous web comprises a four point pivoting parallelogram armature connecting the upper belt assembly and the lower belt assembly.

4. The apparatus defined in claim 3 wherein said pivoting armature allows said upper feed assembly to pivot upwardly and downwardly forming a floating nip to receive said web, to equalize pressure during delivery and allow said feed assembles to clamp during cutting.

5. The apparatus defined in claim 1 wherein said drive means comprises a gear assembly.

6. The apparatus defined in claim 2 wherein said drive means is a gear assembly located at the upstream end of said web delivery means.

7. The apparatus defined in claim 1 wherein said upper web exit clamping means comprises resilient clamping strip attached to said assembly support and disposed upstream from said cutting blade.

8. The apparatus defined in claim 7 wherein said upper web exit clamping strip comprises an antistatic foam and said lower web exit clamping means comprises a positively driven belt assembly.

9. The apparatus defined in claim 1 wherein said upper exit clamping means comprises a roller interconnected to said upper feed assembly.

10. The apparatus defined in claim 1 wherein said cutting blade comprises a knife blade having a serrated edge.

11. The apparatus defined in claim 1 further comprising control means for periodically actuating said web cutting means to sever said web, advance said severed web to a further workstation, and advance said continuous web to a cutting position.

12. An apparatus for continuous web cutting into sheets of predetermined length comprising:

continuous web supply means, web delivery means comprising upper and lower belt assemblies positioned one above and forced against the other forming a floating nip to engage said continuous web, said upper and lower belt assemblies interconnected by a four point pivoting parallelogram armature and gear assembly means located at the upstream end of said web delivery means, whereby said belt assemblies are positively driven in opposite directions, said belt assemblies forming oppositely disposed upper and lower friction surfaces whereby said continuous web is delivered therebetween along a predetermined path of travel to web cutting means, said gear assembly means comprising a driving gear attached to said lower belt assembly and an interconnecting upper gear, said upper belt assembly being adapted to reduce the force exerted by said upper belt assembly against said lower belt assembly as said continuous web enters said nip and said upper belt assembly being adapted to increase the clamping force on said continuous web during segmenting, web cutting means downstream of said web delivery means comprising, cutting blade for segmenting said continuous web and clamping assembly extending laterally across the plane of said web having a cutting blade and upper exit clamping means disposed on the upstream side of said cutting blade, and lower exit clamping means disposed on the opposite side of said web from said upper exit clamping means whereby said upper exit clamping means clamps said web when engaged with said lower exit clamping means and said lower exit clamping means advances said sheet from said web cutting means following cutting, and control means for delivering said continuous web and periodically actuating said web cutting means to sever said web while said continuous web is clamped between said upper and lower belt assemblies.

13. A method for successively segmenting continuous webs into sheets of predetermined lengths comprising the steps of:

advancing said continuous web into a nip formed by upper feed assembly and lower feed assembly positioned one above and forced against the other along a generally horizontal predetermined path to a web cutting position, reducing the force exerted by said upper feed assembly against the lower feed assembly as said web enters said nip, and equalizing said force as the continuous web advances between the upper and lower assemblies to said web cutting position, engaging and clamping said continuous web in an immovable position on the downstream side of said cutting position, engaging and clamping said continuous web on the upstream side of said cutting position by said upper and lower feed assemblies while in said immovable position, cutting said continuous web to predetermined sheet length while said web is in said immovable position, releasing said continuous web and said sheet from said immovable positions, and removing said sheet from the cutting position.

14. The method as defined in claim 13 further comprising the step of simultaneously advancing said continuous web to said cutting position as said sheet is removed from said cutting position.

15. The method as defined in claim 13 wherein said web is a soft, pliable plastic material.

16. The method as defined in claim 13 wherein said web is of varying thicknesses.

* * * * *